US006427791B1

(12) United States Patent
Glowka et al.

(10) Patent No.: US 6,427,791 B1
(45) Date of Patent: Aug. 6, 2002

(54) DRILL BIT ASSEMBLY FOR RELEASABLY RETAINING A DRILL BIT CUTTER

(75) Inventors: David A. Glowka, Austin, TX (US); David W. Raymond, Edgewood, NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 1 day.

(21) Appl. No.: 09/764,082

(22) Filed: Jan. 19, 2001

(51) Int. Cl.[7] ..... E21D 17/10
(52) U.S. Cl. ..... 175/413; 299/102
(58) Field of Search ..... 175/413, 426, 175/432; 299/102, 103

(56) References Cited

U.S. PATENT DOCUMENTS 3,024,856 A * 3/1962 Henning
3,726,352 A * 4/1973 Olov Roos ..... 175/413
3,749,190 A 7/1973 Shipman ..... 175/410
3,771,612 A 11/1973 Adcock ..... 175/413
3,820,849 A 6/1974 Lundström et al. ..... 299/93
4,271,917 A 6/1981 Sahley ..... 175/410
4,323,131 A * 4/1982 Allee ..... 175/413
5,322,351 A 6/1994 Lent ..... 299/87
5,906,245 A 5/1999 Tibbitts et al. ..... 175/426
6,220,671 B1 * 4/2001 Montgomery, Jr. ..... 299/102

* cited by examiner

*Primary Examiner*—William Neuder
(74) *Attorney, Agent, or Firm*—James Durkis; Dickson G. Kehl; Paul A. Gottlieb

(57) ABSTRACT

A drill bit assembly is provided for releasably retaining a polycrystalline diamond compact drill bit cutter. Two adjacent cavities formed in a drill bit body house, respectively, the disc-shaped drill bit cutter and a wedge-shaped cutter lock element with a removable fastener. The cutter lock element engages one flat surface of the cutter to retain the cutter in its cavity. The drill bit assembly thus enables the cutter to be locked against axial and/or rotational movement while still providing for easy removal of a worn or damaged cutter. The ability to adjust and replace cutters in the field reduces the effect of wear, helps maintains performance and improves drilling efficiency.

7 Claims, 2 Drawing Sheets

DRILL BIT ASSEMBLY FOR RELEASABLY RETAINING A DRILL BIT CUTTER

CONTRACTUAL ORIGIN OF THE INVENTION

The United States Government has rights in this invention pursuant to Contract Number DE-AC04-94AL85000 between the United States Department of Energy and Sandia National Laboratories.

BACKGROUND OF THE INVENTION

1. Field of the Invention

The present invention relates to rock drill bits, and more particularly to a rock drill bit assembly for releasably mounting drill bit cutters.

2. Related Art

Polycrystalline Diamond Compact (PDC) drill bits used for rock drilling are currently manufactured using PDC cutters that are cast into, or brazed onto, a tungsten carbide bit body. Alternatively, the cutters are sometimes brazed onto a stud that is then inserted into a steel bit body. However, these bits are expensive to manufacture and for several reasons are limited in performance.

Currently, field adjustment and/or replacement of worn or damaged PDC cutters is extremely difficult and sometimes impossible. As PDC cutters wear, the efficiency of the bit is reduced. If the cutters are brazed into a bit body, these cutters cannot be subsequently rotated within their cutter seats-preventing utilization of the entire perimeter of the cutter as a leading edge. In addition, premature failure of any single PDC cutter, if not replaced, results in accelerated wear and/or failure of the entire bit.

Another problem with the brazing process conventionally used to affix cutters to the bit body is that it requires very high temperatures. The heat generated during this process results not only in weakening of the surrounding bit structure itself—causing greater likelihood of cutter attachment failure during use—but also results in the likelihood of heat damage to the cutter's synthetic diamond structure—causing greater wear and premature need for replacement.

U.S. Pat. No. 3,749,190 teaches a rock drill bit that uses a wedged sleeve insert to retain the cutter. The cutter is composed of a tapered carbide button that is inserted into a straight hole where the sleeve is forced around the cutter. The cutter is retained in the drill bit by the shear strength of the wedged sleeve. If properly secured, subsequent cutter removal and replacement can be extremely difficult.

U.S. Pat. No. 3,771,612 teaches a rock drill bit that uses a mounting device to secure the cutter in a recess in the drill bit. The mounting device being a onepiece goblet-shaped unit consisting of a sleeve for receiving the cutter and a pedestal for supporting the cutter. Release and replacement of the cutter requires the application of a significant axial force sufficient to deform the mounting device, allowing for cutter release.

U.S. Pat. No. 3,820,849 teaches a rock drill bit that uses a wedge insert to retain the cutter. The cutter has a T-shaped base end that is secured in a recess in the drill bit, restricting vertical movement of the cutter, and a wedge is then placed in the same recess to restrict lateral movement of the cutter. While this design allows for easier cutter replacement, secure retention of the cutter is not possible in all drilling orientations.

U.S. Pat. No. 4,271,917 teaches the use of a locking pin to secure the cutter. The locking pin is placed into a small bore alongside the cutter recess and is hammered into place.

Use deforms the locking pin, which more tightly secures the cutter, yet makes subsequent cutter replacement difficult.

U.S. Pat. No. 5,322,351 teaches the use of a trapezoid-shaped wedge with a central locking bolt, in combination with a specially designed recess, to secure a cutter mounting assembly onto a rotary cutter.

U.S. Pat. No. 5,906,245 teaches a resilient split ring to secure a cutter, with a corresponding annular ring, into a drill bit recess. Rapid installation and removal of the cutter is accomplished by overcoming the tension in the resilient ring when inserting or removing the cutter. Failure of the resilient ring results in failure of attachment or greater difficulty in removing a worn or damaged cutter.

Despite this diversity of prior art, there remains a need for an apparatus and method for retaining cutters on a drill bit body that allows for quick and easy cutter installation and replacement as well as for allowing a worn cutter to be reused rather than replaced.

SUMMARY OF THE INVENTION

According to the invention, there is provided a drill bit assembly wherein a drill bit cutter is releasably retained. The drill bit assembly provides locking of the cutter in place on the drill bit body, yet permits easy removal when necessary to adjust or replace the cutter.

According to one aspect of the invention, a drill bit device or assembly is provided which comprises: a drill bit body with a first cavity formed therein; a second cavity formed therein adjacent to, and intersecting one side of, the first cavity; a disc-shaped cutter received in the first cavity; a wedge-shaped cutter lock element received in the second cavity for releasably retaining the cutter in the first cavity; and a removable fastener for releasably retaining the cutter lock element in said second cavity.

Preferably, the first cavity is of a semi-cylindrical shape with a concave bottom surface disposed such that when the disc-shaped cutter and the wedge-shaped cutter lock element are received in the first and second cavities, respectively, the cutter lock element securely retains the disc-shaped cutter in place.

The second cavity preferably comprises an upper wedge-shaped portion and a smaller lower cylindrical portion. Advantageously, the upper wedge-shaped portion is defined by at least two side surfaces that are tapered inward toward a bottom surface. Advantageously, the lower cylindrical portion intersects the bottom surface of the wedge-shaped portion and has a cross-sectional area less than the area of the bottom surface of the wedge-shaped portion. In one embodiment, the cylindrical portion includes screw threading.

In an important implementation, the disc-shaped cutter comprises a substrate disc with a layer of preferably polycrystalline diamond (PCD) bonded to at least one of the two planar surfaces. The substrate is typically formed from a hard material such as tungsten carbide.

In one embodiment, the wedge-shaped cutter lock comprises a wedge that is trapezoidal in cross-section, having four sides, a top surface and bottom surface, with at least one of the cutter lock sides tapering inward towards the bottom surface. A hole extends through the wedge from the top surface to the bottom surface. The shape of the hole is complementary to the shape of the fastener used with the hole.

The fastener comprises a removable mechanical fastener, preferably a screw.

Further features and advantages of the present invention will be set forth in, or apparent from, the drawings and detailed description that follows.

DESCRIPTION OF THE PREFERRED EMBODIMENTS

Figure 1:
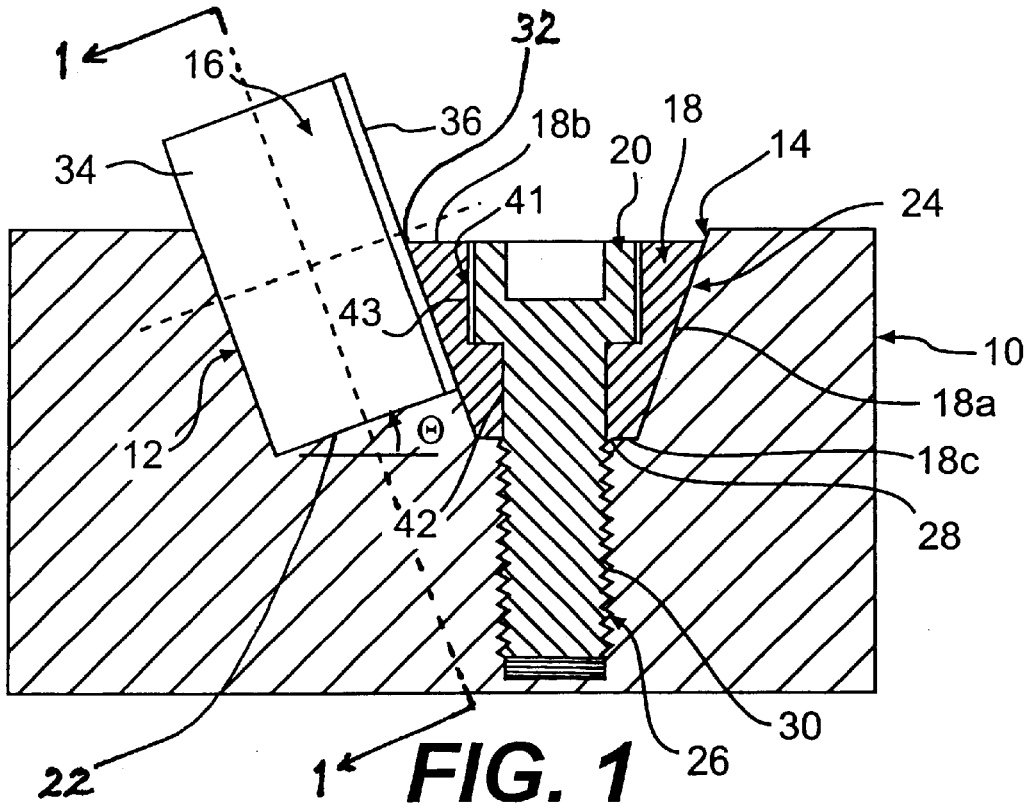
FIG. 1 is a longitudinal cross-sectional view of a drill bit assembly constructed in accordance with a preferred embodiment of the present invention.
Figure 2:
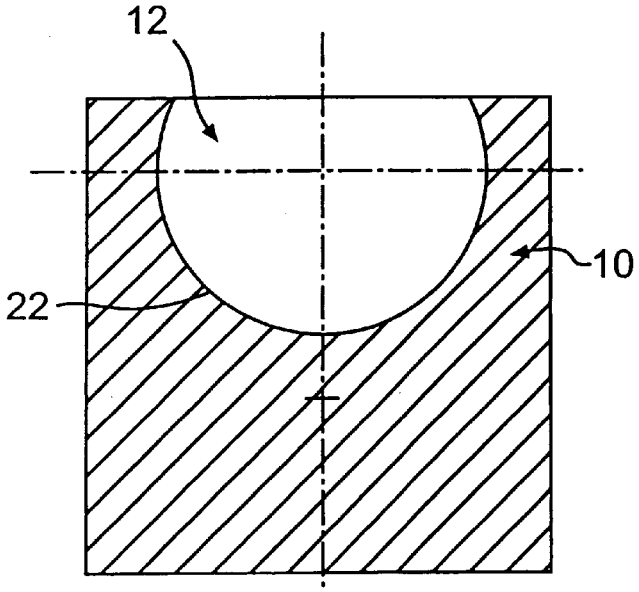
FIG. 2 is a transverse cross-sectional view of a first cavity formed in the drill bit body of the drill bit assembly taken along line 1—1 of FIG. 1.

Referring now to the drawings and particularly to FIGS. 1 and 2, a drill bit body 10 includes a first cavity 12 and a second cavity 14 formed therein. A flat, circular, substantially disc-shaped cutter 16 (see also FIG. 3) is received in the first cavity 12 and a wedge-shaped cutter lock element 18 is received in the second cavity 14. A removable fastener 20 is used to secure the cutter lock 18 in the second cavity 14.

The drill bit body 10 is typically formed from steel, although, alternatively, can be formed from tungsten carbide.

As shown in FIG. 2, the first cavity 12 is generally semi-cylindrical with a concave bottom surface 22 so as to receive a major portion of the round disc-shaped cutter 16. As shown in FIG. 1, the concave bottom surface 22 is disposed at an angle θ, with θ being preferably an acute angle with respect to horizontal.

As best seen in FIG. 1, the second cavity 14 comprises a wedge-shaped upper portion 24 and a cylindrical lower portion 26. The wedge-shaped upper portion 24 tapers inwardly, i.e., towards a flat bottom surface 28 thereof. The cylindrical lower portion 26 intersects the wedge-shaped upper portion 24 at the bottom surface 28 of the wedge-shaped upper portion 24. The diameter of the cylindrical lower portion 26 is smaller than that of the bottom surface 28. The cylindrical lower portion 26 preferably includes screw threads 30. As best seen in FIG. 1, the second cavity 14 is formed adjacent the first cavity 12 such that the adjacent side of the wedge-shaped upper portion 24 intersects the first cavity 12. The cavities 12 and 14 are preferably either machined directly into a steel bit body or formed in a piece of steel stock cast into a tungsten carbide bit body.

Figure 3:
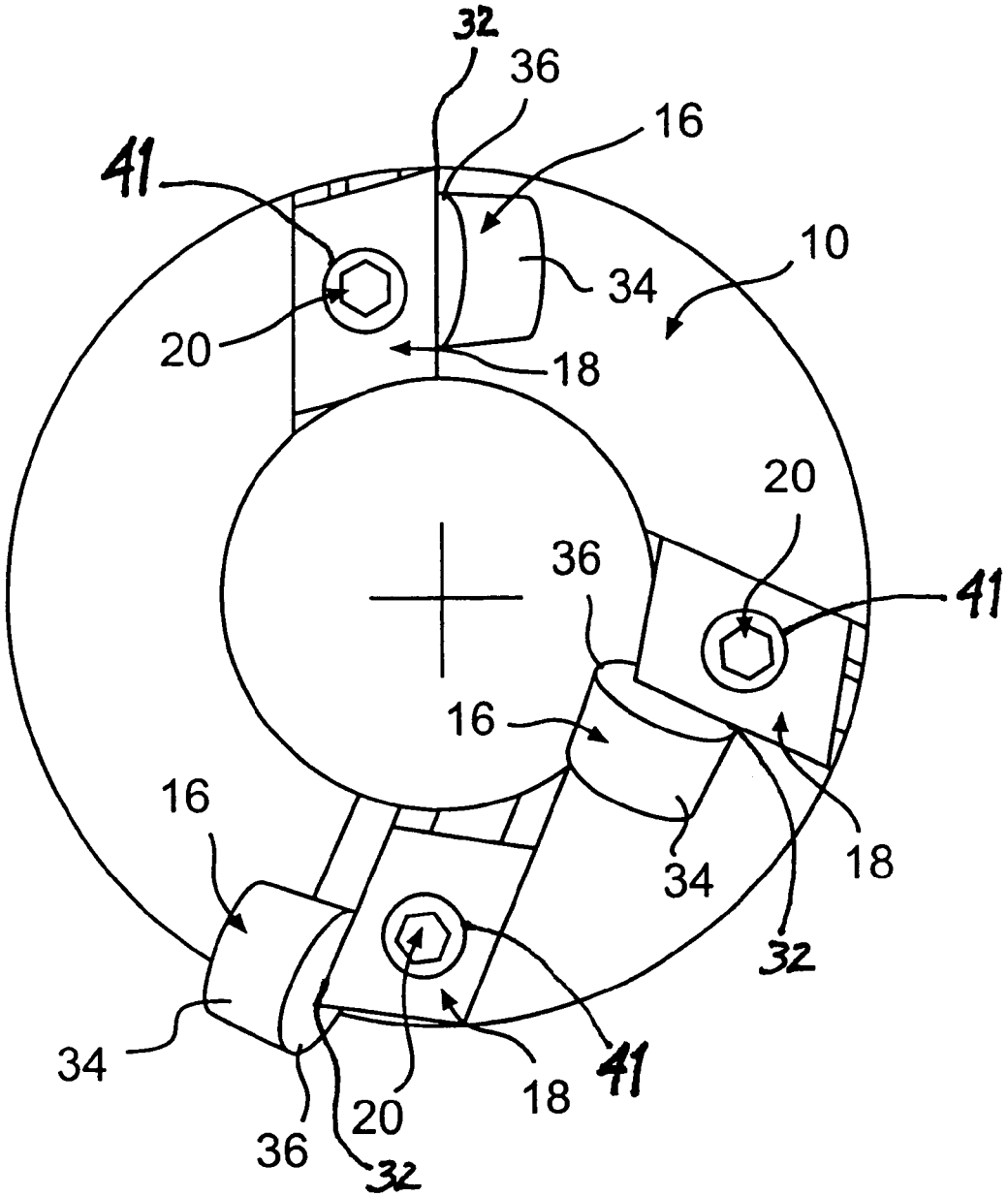
FIG. 3 is a top plan view of a drill bit device incorporating drill assemblies corresponding to that shown in FIG. 1.

As shown in FIGS. 1 and 3, the disc-shaped cutter 16 comprises a disc-shaped substrate 34 with a layer of polycrystalline diamond 36 bonded to at least one of the two planar surfaces thereof. The substrate 34 is typically formed from a hard material such as tungsten carbide. The disc-shaped cutter 16 is positioned in the first cavity 14, such that a layer of polycrystalline diamond 36 is disposed adjacent the intersection of the first and second cavities 32.

The wedge-shaped cutter lock element 18 has side surfaces 18*a* that are complementary in shape to the wedge-shaped upper portion 24 of the second cavity 14. As best seen in FIG. 1, the cutter lock element 18 is in the shape of an inverted trapezoid when viewed from the side. And, as best seen in FIG. 3, the cutter lock element 18 has a parallelogram shape. As seen in FIG. 1, cutter lock element 18 has four side surfaces 18*a* (only two of which are shown in FIG. 1), a top surface 18*b* and a bottom surface 18*c*. The top surface 18*b* has a greater surface area than the bottom surface 18*c*. A hole 41 extends through the wedge-shaped cutter lock element 18 from the top surface 18*b* to the bottom surface 18*c*. The hole 41 comprises a channel portion 42 and countersunk portion 43. The hole 41 is positioned in the wedge-shaped cutter lock 18 such that the channel 42 and cylindrical lower portion 26 of cavity 14 are in alignment when the wedge-shaped cutter lock 18 is inserted in the wedge-shaped upper portion 24 of cavity 14. The wedge-shaped cutter lock element 18 and disc-shaped cutter 16 are so aligned that a polycrystalline layer 36 of the disc-shaped cutter 16 is engaged by one side of the wedge-shaped cutter lock element 18*a*.

The fastener 20 can be any removable mechanical fastener and preferably is a screw. The fastener 20 is inserted through the hole 41 of the wedge-shaped cutter lock 18 and threadedly inserted into the cylindrical lower portion 26 of the second cavity 14.

The present invention overcomes many of the disadvantages in the prior art and has many advantages including the ability to lock the cutter within the drill bit body so as to prevent axial and/or rotational movement when locked, yet still allowing easy removal of the cutter in the field. The ability to adjust and replace cutters in the field reduces the effects of wear and maintains performance and drilling efficiency. Another advantage of the invention is the elimination of the need for, and the disadvantages of, the brazing process using in the manufacture of prior PDC drill bits.

Although the invention has been described above in relation to preferred embodiments thereof, it will be understood by those skilled in the art that variations and modifications can be effected in these preferred embodiments without departing from the scope and spirit of the invention.

We claim:

1. A drill bit assembly comprising:

a bit body including a first cavity formed therein and a second cavity formed therein adjacent to and intersecting said first cavity on one side thereof;

a disc-shaped cutter received in said first cavity;

said first cavity being semi-cylindrical in shape and having a concave bottom surface against which a side surface of said cutter bears;

a wedge-shaped cutter lock element received in said second cavity for releasably locking said cutter in said first cavity; and a removable fastener for releasably retaining the cutter lock element in said second cavity.

2. A drill bit assembly comprising:

a bit body including a first cavity formed therein and a second cavity formed therein adjacent to and intersecting said first cavity on one side thereof;

a disc-shaped cutter received in said first cavity;

a wedge-shaped cutter lock element received in said second cavity for releasably locking said cutter in said first cavity;

a removable fastener for releasably retaining the cutter lock element in said second cavity; and said second cavity comprises a wedge-shaped portion in which said lock element is received and a further portion extending downwardly from said wedge-shaped portion in which a part of said fastener is received.

3. An assembly according to claim 2 wherein said wedge-shaped portion has at least two sides and a bottom surface, and said sides taper inwards towards said bottom surface, and said further portion comprises a cylindrical portion disposed below and intersecting said bottom surface.

4. A drill bit assembly comprising:

a bit body including a first cavity formed therein and a second cavity formed therein adjacent to and intersecting said first cavity on one side thereof;

a disc-shaped cutter received in said first cavity;

a wedge-shaped cutter lock element received in said second cavity for releasably locking said cutter in said first cavity;

a removable fastener for releasably retaining the cutter lock element in said second cavity;

said lock element comprises a trapezoid wedge having four sides, a top surface, and a bottom surface, said top surface having greater area than said bottom surface, said wedge having a hole formed therein, and said hole extending from said top surface to said bottom surface; and said fastener comprises a screw with a head and said hole includes a countersunk upper portion for receiving said head.

5. A drill bit assembly for releasably retaining a disc-shaped polycrystalline diamond compact drill bit, said assembly comprising:

a bit body including a first drill bit receiving cavity opening at an upper surface of the body, having a generally semicircular shape in transverse cross section, and including a bottom surface forming an acute angle with a horizontal plane through the intersection between said bottom surface and one flat side of first cavity, and a second cavity disposed adjacent to said first cavity and intersecting said first cavity on a side thereof opposite to said one side;

a cutter lock element, received in said second cavity and having a flat slant side surface extending substantially parallel to said one side of said first cavity, for engaging a drill bit received in said first cavity; and a removable fastener for releasably retaining the cutter lock element in said second cavity.

6. An assembly according to claim 5, wherein said second cavity comprises a wedge-shaped portion in which said lock element is received and a further portion extending downwardly from said wedge-shaped portion in which a part of said fastener is received.

7. An assembly according to claim 5 wherein said wedge-shaped portion has four sides and a bottom surface, and said sides taper towards said bottom surface, and said further portion comprises a cylindrical portion disposed below and intersecting said bottom surface.

* * * * *